US012680750B2

(12) United States Patent
Ha

(10) Patent No.: US 12,680,750 B2
(45) Date of Patent: Jul. 14, 2026

(54) REFRIGERATOR

(71) Applicant: LG ELECTRONICS INC., Seoul (KR)

(72) Inventor: Seungpyo Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 168 days.

(21) Appl. No.: 18/605,164

(22) Filed: Mar. 14, 2024

(65) Prior Publication Data

US 2024/0310110 A1 Sep. 19, 2024

(30) Foreign Application Priority Data

Mar. 15, 2023 (KR) ..... 10-2023-0034073

(51) Int. Cl.
*F25D 23/02* (2006.01)

(52) U.S. Cl.
CPC ..... *F25D 23/028* (2013.01)

(58) Field of Classification Search
CPC ..... F25D 23/028; F25D 2323/024; F25D 23/025; F25D 23/04; F25D 2323/021; F25D 2323/023; F25D 2400/18; E05D 7/081; E05Y 2900/31
See application file for complete search history.

(56) References Cited

U.S. PATENT DOCUMENTS

| | | | | |
|---|---|---|---|---|
| 10,342,363 | B2 * | 7/2019 | Park | A47F 3/0434 |
| 10,436,504 | B2 * | 10/2019 | Lee | G06F 3/044 |
| 10,458,164 | B2 * | 10/2019 | Wantland | E05F 1/043 |
| 12,270,594 | B2 * | 4/2025 | Kim | F25D 23/028 |
| 2014/0232251 | A1 * | 8/2014 | Kim | F25D 23/025 312/405 |
| 2020/0024880 | A1 * | 1/2020 | Liu | F25D 23/028 |
| 2020/0025438 | A1 | 1/2020 | Liu et al. | |
| 2021/0262722 | A1 * | 8/2021 | Son | F25D 23/028 |
| 2022/0221218 | A1 * | 7/2022 | Kwon | F25D 23/126 |

FOREIGN PATENT DOCUMENTS

| | | | | |
|---|---|---|---|---|
| CN | 105546912 | A * | 5/2016 | E05D 7/081 |
| EP | 3086061 | A1 * | 10/2016 | F25D 23/02 |
| EP | 3 244 147 | A1 | 11/2017 | |
| EP | 3926273 | A2 * | 12/2021 | F25D 23/028 |
| JP | 2017026193 | A * | 2/2017 | F25D 23/02 |
| KR | 101728196 | B1 * | 4/2017 | A47F 3/001 |
| KR | 20200007991 | A * | 1/2020 | F25D 27/00 |
| WO | WO-2011081279 | A1 * | 7/2011 | F25D 23/085 |
| WO | WO-2016175563 | A1 * | 11/2016 | F25D 23/02 |

* cited by examiner

*Primary Examiner* — Hanh V Tran
(74) *Attorney, Agent, or Firm* — Birch, Stewart, Kolasch & Birch, LLP

(57) ABSTRACT

A refrigerator including a cabinet having a storage space; a main door rotatably mounted on the cabinet to open and close the storage space, and having an opening; a sub door disposed in front of the main door and rotatably opening and closing the main door; and a hinge rotatably connected to the sub door, in which the main door includes a door body forming a circumference of the opening and filled with an insulating material; and a lower cap decoration coupled to the door body and forming a portion of a lower surface and a front surface of the main door. The hinge is mounted on the lower cap decoration.

18 Claims, 13 Drawing Sheets

REFRIGERATOR

CROSS-REFERENCE TO RELATED APPLICATIONS

The present application claims the benefit under 35 U.S.C. § 119 of Korean Patent Application No. 10-2023-0034073, filed in the Republic of Korea on Mar. 15, 2023, which is hereby incorporated by reference in its entirety.

BACKGROUND

The present disclosure relates to a refrigerator.

In general, a refrigerator is a home appliance that allows food to be stored at low temperatures in an internal storage space shielded by a refrigerator door. To this end, the refrigerator is designed to keep stored food in optimal condition by cooling the inside of the storage space using cold air generated through heat exchange with the refrigerant circulating in the refrigeration cycle.

Recently, the refrigerator is gradually becoming larger and more multi-functional in accordance with changes in eating habits and the trend toward higher quality products, and a refrigerator with various structures that take user convenience into consideration are being released.

As an example, there is a refrigerator whose door consists of a main door and a sub door, and having a structure in which food may be stored in a storage space inside the main door by opening the sub door.

The sub door of such a refrigerator may be rotatably mounted using a hinge. However, if the hinge supporting a lower end of the sub door is mounted on the front surface of the main door and exposed to the outside, there is a problem of poor outer appearance.

Additionally, when the weight of the sub door increases, the size of the hinge increases, resulting in a worse outer appearance. In particular, if the weight of the sub door is heavy, the hinge may be deformed and the sub door may sag.

SUMMARY

An object of an embodiment of the present disclosure is to provide a refrigerator having a hinge mounting structure with reinforced strength.

An object of an embodiment of the present disclosure is to provide a refrigerator having a structure that minimizes exposure of the hinge.

An object of an embodiment of the present disclosure is to provide a refrigerator with an improved outer appearance of the door.

A refrigerator according to an embodiment of the present disclosure includes a cabinet having a storage space; a main door rotatably mounted on the cabinet to open and close the storage space, and having an opening; a sub door disposed in front of the main door and rotatably opening and closing the main door; and a hinge rotatably connected to the sub door, in which the main door may include a door body forming a circumference of the opening and filled with an insulating material; and a lower cap decoration coupled to the door body and forming a portion of a lower surface and a front surface of the main door, and the hinge may be mounted on the lower cap decoration.

The lower cap decoration may be formed with a protrusion that protrudes further forward than the front surface of the door body, and the hinge may be mounted on the protrusion.

A recessed accommodation part may be formed on an upper surface of the protrusion to allow the hinge to be inserted.

The protrusion may protrude further downward than the sub door in a front direction, and the lower cap decoration may be exposed below the sub door.

A recessed handle may be formed on the side farthest from the hinge among both left and right sides of the lower surface of the sub door, and a recessed part which extends further rearward than the handle from the protrusion may be formed on the front surface of the lower cap decoration.

The storage space may include an upper storage space and a lower storage space disposed vertically, the upper storage space may be opened and closed by a pair of main doors, the lower storage space may be opened and closed by a lower door, and the recessed part may be disposed behind a lower handle recessed in an upper surface of the lower door, and the protrusions may be disposed on both sides of the lower handle.

The lower cap decoration may be provided with a support member for supporting the sub hinge.

The support member may be formed of a plate-shaped metal material, and the support member may have one side which is fixed to the door body and the other side which protrudes in front of the door body to support the hinge from below.

The support member may include a first support part coupled to a lower surface of the door body; and a second support part extending forward from the first support part and coupled to a lower surface of the hinge, and the second support part may be formed to be stepped higher than the first support part.

A recessed accommodation part may be formed in the lower cap decoration to accommodate the hinge, and the second support part may support a lower surface of the accommodation part.

The refrigerator may further include a first fastening member configured to penetrate the hinge and the accommodation part and fastened to the second support part.

The refrigerator may further include a second fastening member configured to penetrate the lower cap decoration and the first support part and is fastened to the door body.

A downwardly bent front support part may be formed at a front end of the second support part, and a front end of the front support part may be in contact with a front surface of the lower cap decoration, and a lower end of the front support part may be in contact with a lower surface of the lower cap decoration.

The lower cap decoration may include a first part coupled to a lower surface of the door body to form the lower surface of the main door; and a second part coupled to the first part to protrude forward from a lower end of the front surface of the main door, and the hinge may be mounted on the second part.

The first part may be formed to have a different texture from the second part.

The second part may include an upper surface protruding further than the front surface of the main door and into which the hinge is inserted; and a circumferential surface extending downward along a front end of the upper surface and exposed below the sub door, and at least a portion of a rear surface of the second part may be open to allow the support member to be inserted.

The hinge may include a fixing part inserted into a recessed accommodation part of the lower cap decoration; a bent part extending stepwise from one end of the fixing part and seated on an upper surface of the accommodation part;

and a hinge pin protruding upward from the bent part and axially coupled to a lower surface of the sub door.

A support member having one end which is coupled to the door body, and the other end which supports the hinge from below may be provided inside the lower cap decoration, a lower support member is mounted on the outer surface of the lower cap decoration to reinforce the support member, and the support member and the lower support member are formed of a metal material.

The refrigerator may further include a first fastening member configured to sequentially penetrate the hinge, the support member and the lower cap decoration and fastened to the lower support member; and a second fastening member configured to sequentially penetrate the lower support member, the lower cap decoration, and the support member and fastened to the door body.

A stopper part protruding downward and restricting the rotation angle of the main door may be formed on the lower support member.

The refrigerator according to an embodiment of the present disclosure has the following effects.

According to this embodiment, a lower cap decoration is formed at the lower end of the main door, and a hinge to which the sub door is axially coupled is mounted on the lower cap decoration. In addition, the lower cap decoration has the advantage of reinforcing the strength of the hinge by further providing a support member connecting the main door and the hinge.

In particular, even when the weight of the sub door is heavy, there is an advantage that the support member may stably support the sub door by supporting the hinge from below and may prevent sagging of the sub door and deformation of the lower cap decoration.

In addition, a lower support member is further provided on the lower surface of the lower cap decoration to support both the support member and the hinge, and thus there is an advantage of reinforcing the strength of the support member and further supporting the sub door from below to prevent sagging of the sub door.

In addition, the hinge for opening the sub door is mounted on the accommodation part of the lower cap decoration, which has the advantage of minimizing external exposure of the hinge and improving the outer appearance even when the sub door is opened.

In addition, by disposing the hinge for opening the sub door on the lower cap decoration, there is an advantage in that the upper surface of the lower door where the handle is formed can be formed in a flat shape, further improving the outer appearance.

Additionally, the lower cap decoration may be composed of a first part that forms the lower surface of the main door and a second part that forms the lower end of the front surface of the main door. Accordingly, there is an advantage in that the material or texture of the second part exposed to the outside is different from that of the first part to further improve the outer appearance and at the same time provide a mounting structure for the hinge.

In addition, the lower cap decoration is composed of a recessed part passing behind the handle and a protrusion to which the sub door is axially coupled, enabling axial coupling of the sub door and improving convenience of use by preventing interference when using the handle.

DETAILED DESCRIPTION OF THE EMBODIMENTS

Hereinafter, specific embodiments of the present disclosure will be described in detail along with the drawings. However, the present disclosure cannot be said to be limited to the embodiments in which the idea of the present disclosure is presented, and other disclosures that are regressive or other embodiments included within the scope of the present disclosure can be easily suggested by adding, changing, or deleting other components.

Before explaining, define the direction. In an embodiment of the present disclosure, the direction in which the front surface of the door illustrated in FIG. 1 faces may be referred to as a front direction, the direction toward the cabinet based on the front surface of the door may be referred to as a rear direction, the direction toward the floor where the refrigerator is installed may be referred to as a downward direction, and the direction away from the floor may be defined as an upward direction. In addition, when you want to talk about an undefined direction, you can define and explain the direction based on each drawing.

Figure 1:
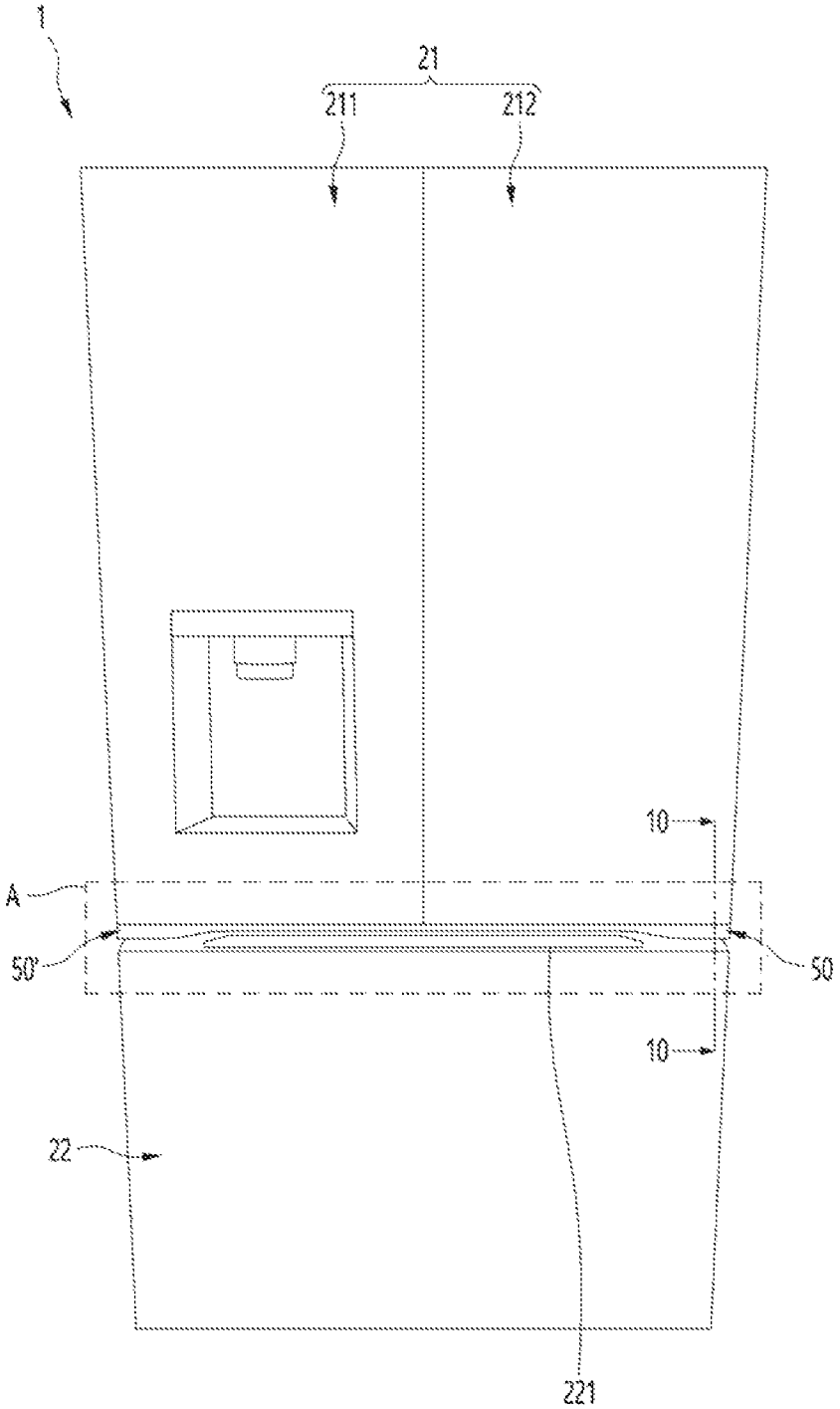
FIG. 1 is a perspective view of a refrigerator according to an embodiment of the present disclosure.
Figure 2:
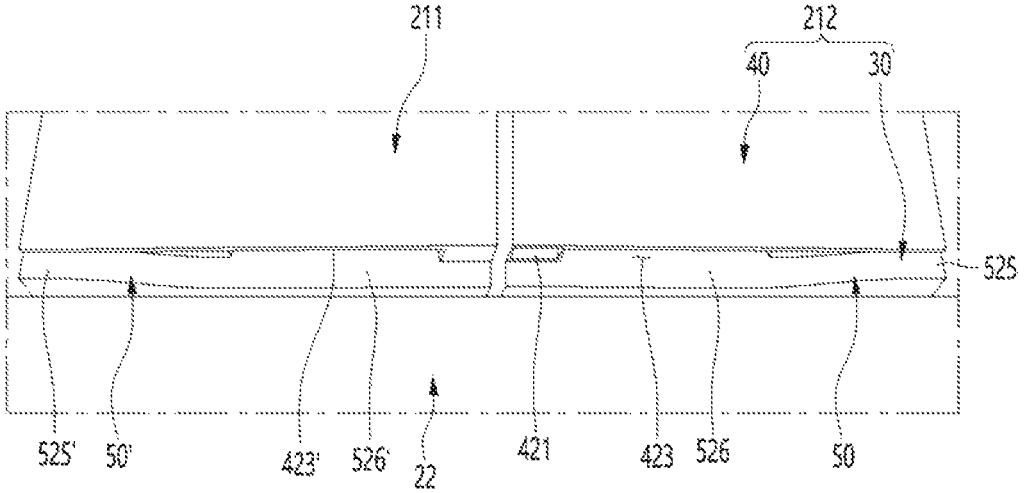
FIG. 2 is a partial perspective view of part A of FIG. 1 viewed from below.

FIG. 1 is a perspective view of a refrigerator according to an embodiment of the present disclosure, and FIG. 2 is a partial perspective view of part A of FIG. 1 viewed from below.

As illustrated, the overall outer appearance of the refrigerator 1 according to an embodiment of the present disclosure may be formed by a cabinet 10 that forms a storage space with an open front surface, and doors 21 and 22 that open and close the storage space.

Storage spaces 11 and 12 may be formed inside the cabinet 10. The inside of the cabinet 10 may be divided up and down to form a plurality of storage spaces 11 and 12 (see FIG. 4). For example, the storage spaces 11 and 12 may be divided into an upper storage space 11 disposed above and a lower storage space 12 disposed below. For example, the upper storage space 11 may be configured as a refrigerating chamber and the lower storage space 12 may be configured as a freezing chamber.

Doors 21 and 22 may be provided in front of the cabinet 10. The doors 21 and 22 may be provided in plural numbers and may be configured to independently open and close the storage spaces 11 and 12, respectively. For example, the doors 21 and 22 may include an upper door 21 disposed at the upper portion and a lower door 22 disposed at the lower portion.

A pair of the upper doors 21 may be disposed on both left and right sides and may be composed of a left door 211 and a right door 212. The upper door 21 may be called a refrigerating chamber door. In addition, the upper door 21 may have a rotatable structure in which the upper and lower ends are axially coupled, and may be called a rotary door.

Meanwhile, at least one of the upper doors 21 disposed on both left and right sides may have a double door structure consisting of a main door 30 and a sub door 40, which will be described below. For example, as illustrated in FIG. 2, the left door 211 may have a single structure, and the right door may have a double door structure. In other words, one of the upper doors 21 may have a single door structure, and the other may have a double door structure.

In addition, a lower cap decoration 50' may be formed at the lower end of the left door 211, which forms the lower end of the front surface of the left door 211 and the lower surface of the left door 211. The lower cap decoration 50' may have a protrusion 525' protruding forward from the left end of the left door 211, and a recessed part 526' extending from the protrusion 525' to the right end of the left door 211. Additionally, the recessed part 526' may be formed to pass behind the handle 423' recessed in the lower surface of the left door 211.

Additionally, a lower cap decoration 50 may be formed at the lower end of the main door 30 of the right door 212. The lower cap decoration 50 may be formed in a shape that is symmetrical to the protrusions 525' and recessed parts 526' formed on the lower cap decoration 50' of the left door 211. In other words, the protrusion 525 on which the hinge 54 is mounted on the right end of the right door 212 may protrude forward, and a recessed part 526 extending from the protrusion 525 to the left end of the right door 212 may be formed. The recessed part 526 may extend to pass behind the handle 423 formed on the lower surface of the sub door 40.

The lower door 22 is composed of a single door and may open and close the lower storage space 12. The lower door 22 may be referred to as a freezing chamber door. For example, the lower door 22 is configured as a drawer type so that the lower storage space 12 may be opened and closed by pulling in and out, and may be referred to as a drawer type door.

A lower handle 221 may be recessed in the upper surface of the lower door 22. The lower handle 221 may be long in the left and right direction, and may be disposed in a direction facing the handle 423 of the upper door 21. Additionally, the lower handle 221 may be disposed ahead of the recessed part 526 of the upper door 21. In addition, the protrusions 525 of the upper door 21 may be located on both left and right sides of the lower handle 221.

Of course, the lower door 22 may be provided in pairs on both left and right sides like the upper door 21, and may be configured to open and close by rotation.

Hereinafter, the right door 212, which has a double door structure among the upper doors 21, will be examined in more detail with reference to the drawings. In addition, for convenience of explanation, the right door 212 will be referred to as a door 212 hereinafter.

Figure 3:
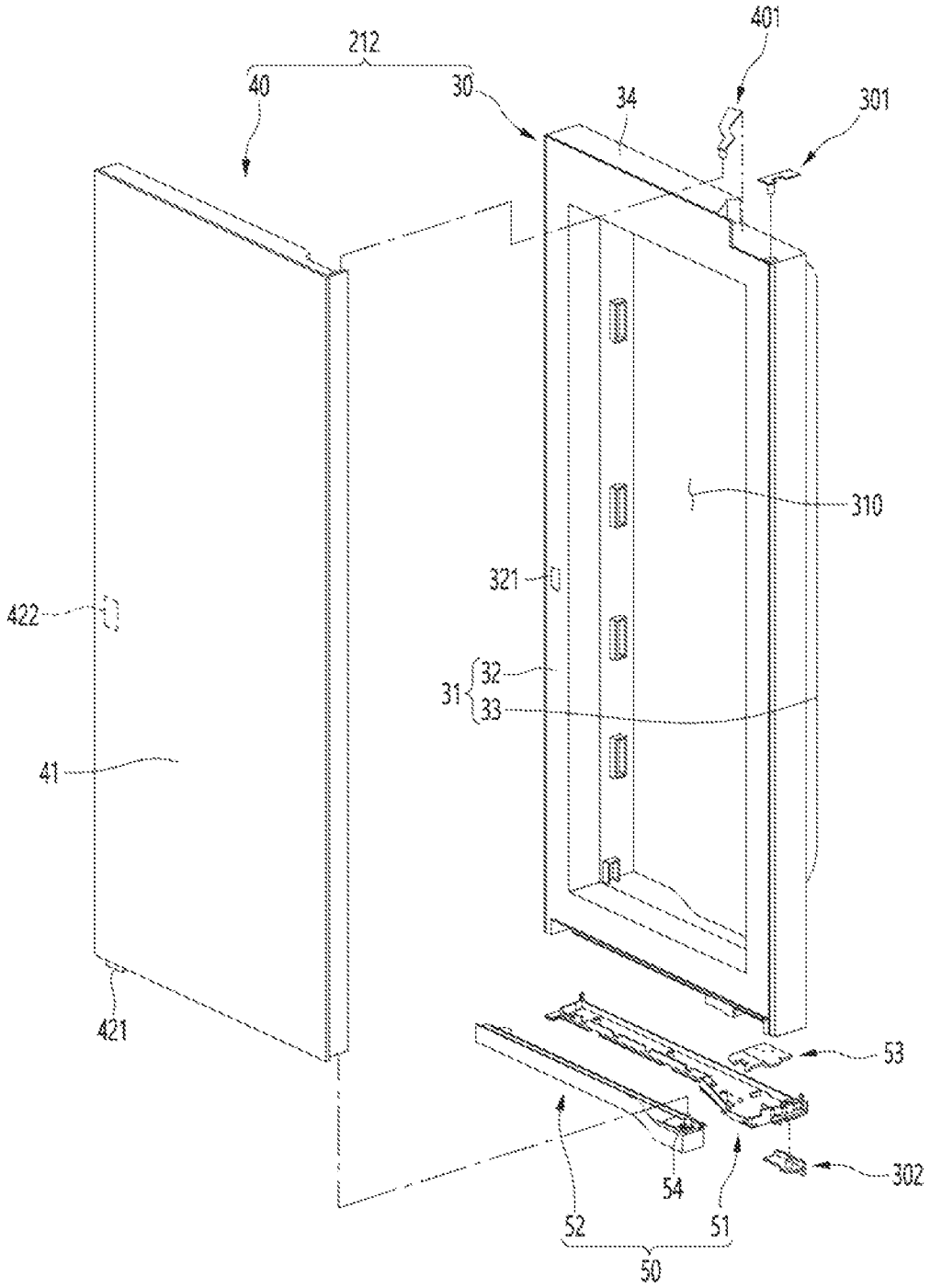
FIG. 3 is an exploded perspective view illustrating the combined structure of the main door and sub door of the refrigerator.
Figure 4:
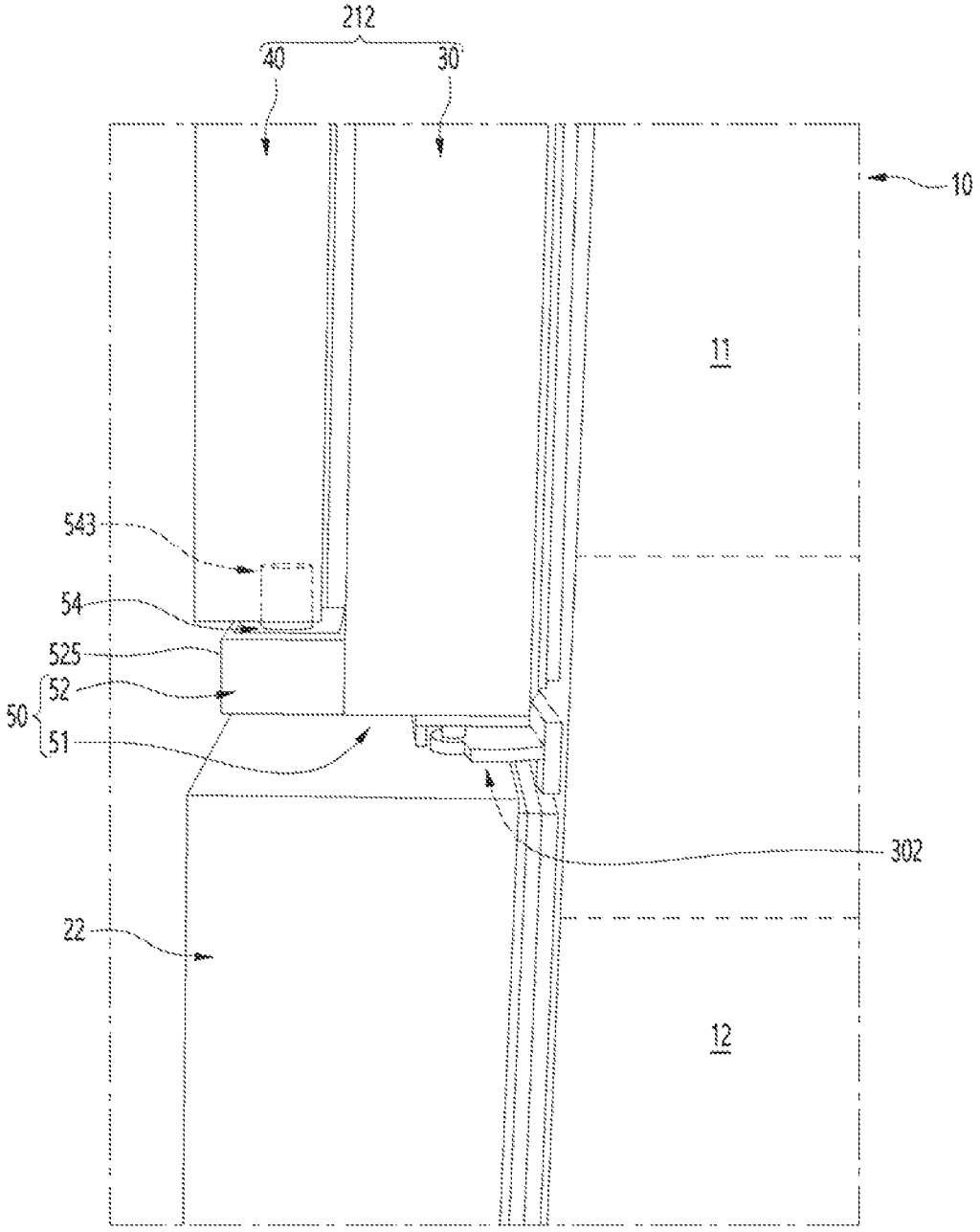
FIG. 4 is a side view illustrating the hinge connection structure of the main door and the sub door.
Figure 5:
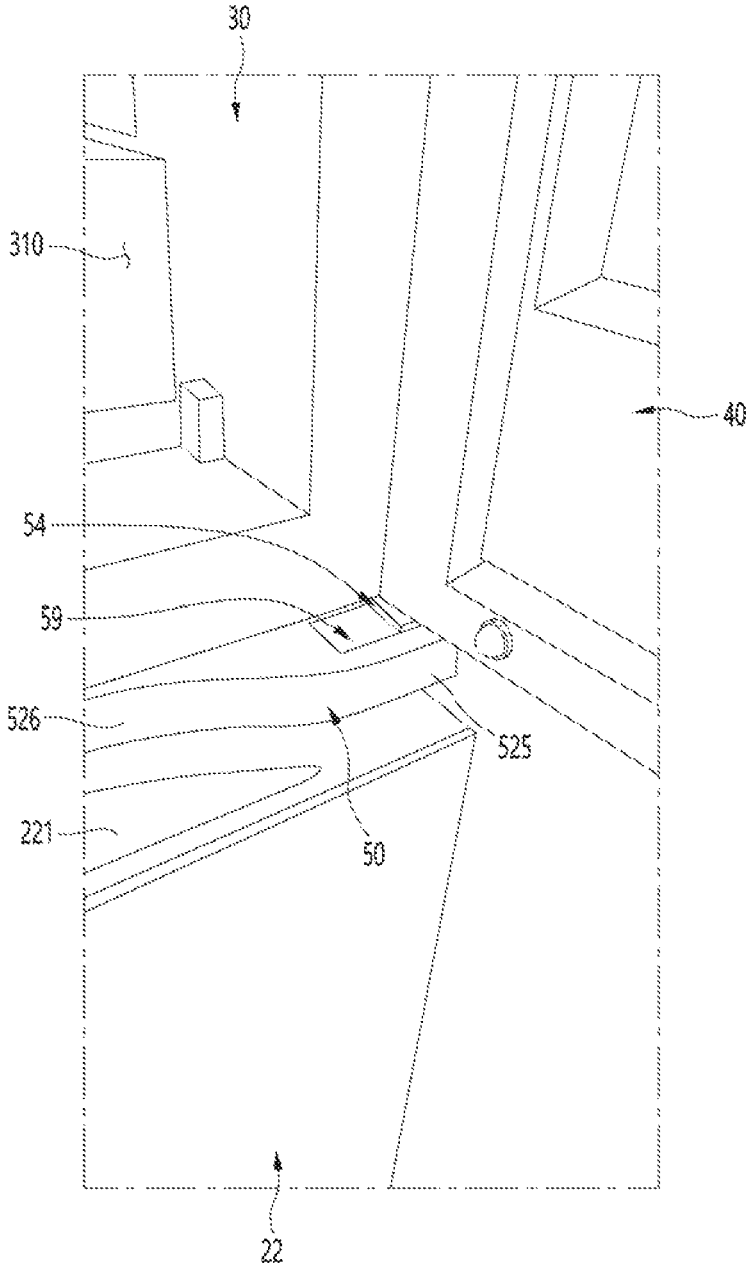
FIG. 5 is a partial perspective view of the sub door in an open state.

FIG. 3 is an exploded perspective view illustrating the combined structure of the main door and sub door of the refrigerator, FIG. 4 is a side view illustrating the hinge connection structure of the main door and the sub door, and FIG. 5 is a partial perspective view of the sub door in an open state.

As illustrated, the right door 212, that is, the door 212, may be composed of a main door 30 and a sub door 40. The main door 30 is used to open and close at least a portion of the upper storage space 11, and the upper and lower ends thereof can be rotatably axially coupled to the cabinet 10 by main hinges 301 and 302.

The main hinges 301 and 302 may include an upper main hinge 301 axially coupled to the upper end of the main door 30 and a lower main hinge 302 axially coupled to the lower end of the main door 30. Additionally, the lower main hinge 302 may be mounted on the front surface of the cabinet 10. Additionally, the lower main hinge 302 protrudes between the lower end of the door 212 and the upper end of the lower door 22 to support the main door 30 from below.

An opening 310 may be formed in the main door 30. Therefore, the upper storage space may be accessible through the opening 310. Additionally, a separate storage space may be provided in the main door 30, and the storage space may be accessible through the opening 310.

The sub door 40 is disposed in front of the main door 30, and can be rotatably mounted on the main door 30 by a hinge 54 and an upper hinge 401, which will be described below. The upper hinge 401 may be axially coupled to the upper end of the sub door 40, and the hinge 54 may be axially coupled to the lower end of the sub door 40.

The front surface of the sub door 40 may be formed by a panel 41. For example, the panel 41 may be made of a material that has an excellent outer appearance, such as metal, ceramic, or glass. As another example, the panel 41 may be configured so that a plurality of glasses are disposed in the front and rear direction and an insulating space is formed between the plurality of glasses so that the inside of the opening 310 is visible.

A handle 423 may be recessed in the lower surface of the sub door 40, through which the user inserts his/her hand to operate the sub door 40 when opening or closing the sub door 40. Additionally, a locking device 422 may be provided on the rear surface of the sub door 40, and an operating member 421 for operating the locking device 422 may be provided on the lower surface of the sub door 40. The operating member 421 may be disposed adjacent to the handle 423.

The locking device 422 may be locked by the restraint part 321 on the front surface of the main door 30 when the sub door 40 is closed. Accordingly, when the user holds and pulls the handle 423, the main door 30 may be opened together with the sub door 40 in a restrained state. In addition, when the user operates the operating member 421 to release the sub door 40 from the main door 30, the sub door 40 can be opened by holding the handle 423. Therefore, the handle 423 can be used to open both the main door 30 and the sub door 40.

Figure 10:
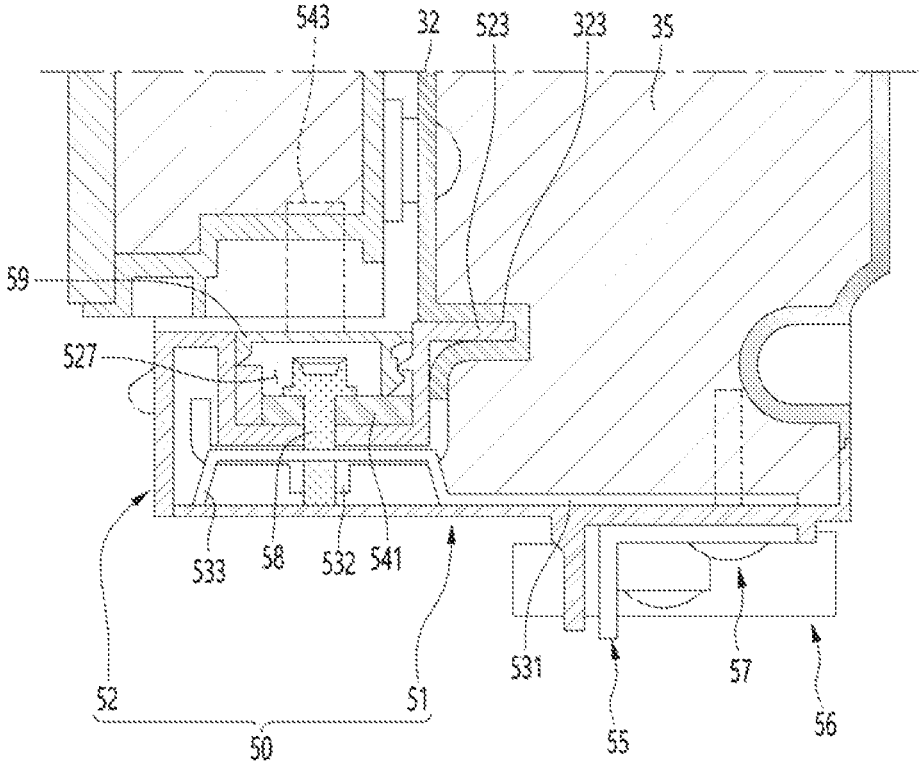
FIG. 10 is a cross-sectional view taken along line 10-10 of FIG. 1.

The main door 30 may include a door body 31 in which the opening 310 is formed and the inside of which is filled with an insulating material 35 (see FIG. 10). The door body 31 may include a door frame 32 that forms the front and circumferential surfaces of the main door 30, and a door liner 33 that forms the rear surface. The door frame 32 may be composed of at least one configuration, and may be combined with each other to form the door frame 32. In addition, the inside of the door body 31, that is, the space between the door frame 32 and the door liner 33, may be filled with an insulating material 35.

Additionally, an upper cap decoration 34 may be provided on the upper surface of the main door 30. The upper cap decoration 34 can connect the upper end of the door frame 32 and the upper end of the door liner 33, and together with the door frame 32 and the door liner 33, can form a space filled with the insulating material 35 in the door body 31.

A lower cap decoration 50 may be provided on the lower surface of the main door 30. The lower cap decoration 50 may be coupled to the lower surface of the door body 31 and may form a portion of the lower surface and front surface of the main door 30. In addition, a support member 53 may be further provided between the door body 31 and the lower cap decoration 50 to reinforce the hinge 54, which will be described below.

The lower cap decoration 50 may be positioned lower than the lower end of the sub door 40 and exposed to the front. Additionally, a protrusion 525 on which the hinge 54 is mounted may be formed on the lower cap decoration 50.

The protrusion 525 protrudes forward from the lower end of the front surface of the main door 30 and may protrude forward between the lower end of the sub door 40 and the upper end of the lower door 22. Additionally, the hinge 54 is provided on the protrusion 525 to support the lower end of the sub door 40. Therefore, the hinge 54 may be referred to as a lower hinge.

The lower cap decoration 50 may form a portion of the outer appearance that is exposed to the front when the door 212 is viewed from the front, and may simultaneously support the sub door 40 from below so that it can rotate.

Meanwhile, an upper hinge 401 may be further provided at the upper end of the main door 30 to be axially coupled to the upper end of the sub door 40. Accordingly, the sub door 40 can be rotated by axially coupling the upper and lower ends thereof.

Hereinafter, the structure of the lower cap decoration 50 will be examined in more detail with reference to the drawings.

Figure 6:
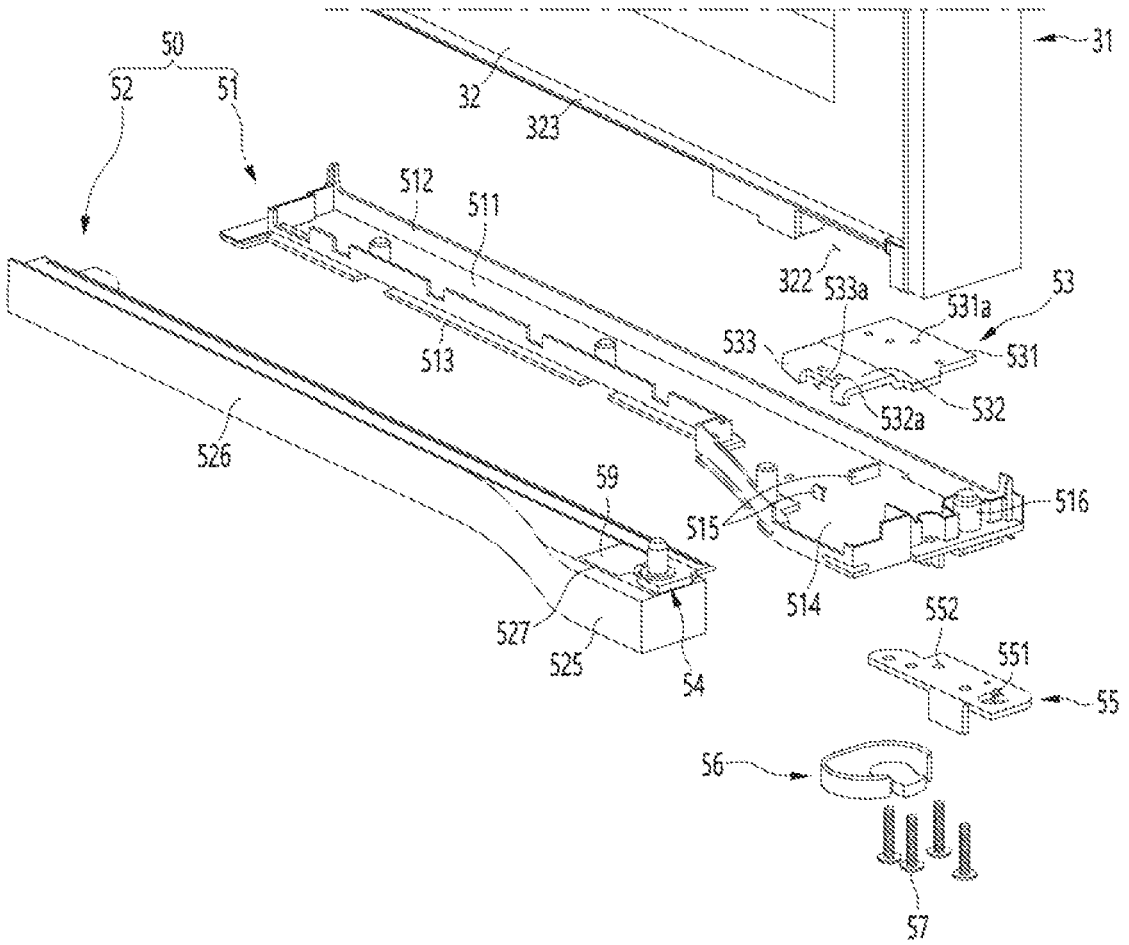
FIG. 6 is an exploded perspective view illustrating the lower structure of the main door.

FIG. 6 is an exploded perspective view illustrating the lower structure of the main door.

As illustrated, the lower cap decoration 50 may be coupled to the lower surface of the door body 31 constituting the main door 30. The lower cap decoration 50 may be connected to the lower end of the door frame 32 and the door liner 33 to form a space filled with the insulating material 35 inside the door body 31. At this time, the support member 53 may be disposed while mounted on the lower cap decoration 50 before foam molding the insulating material 35 inside the door body 31. Of course, the lower cap decoration 50 may be coupled to the lower surface of the door body 31 in which the insulating material 35 is filled.

The lower cap decoration 50 may be composed of a first part 51 and a second part 52. The first part 51 may form the lower surface of the main door 30. Additionally, the second part 52 may be combined with the first part 51 to form a portion of the front surface of the main door 30. Additionally, the second part 52 may be equipped with the hinge 54 for coupling the sub door 40.

In detail, the first part 51 may be made of plastic material. In addition, the first part 51 may be formed with a decoration lower surface 511 and a decoration circumferential surface 512. The decoration circumferential surface 512 is coupled to the lower end of the door body 31, and the decoration lower surface 511 can form the outer appearance of the lower surface of the main door 30. The decoration lower surface 511 may shield the entire lower surface of the door body 31, and at least a portion thereof may protrude toward the front of the main door 30.

The first part 51 may further include a support member mounting part 514 on which the support member 53 is mounted. The support member mounting part 514 may protrude further forward than the door body 31 and form a space in which the support member 53 is accommodated. Additionally, a guide part 515 may be formed on the support member mounting part 514 to guide the support member 53 to be mounted in an accurate position. At least one of the guide parts 515 may protrude upward from the decoration lower surface 511 and come into contact with the circumference of the support member 53. Accordingly, the support member 53 can be fixed to the set position of the first part 51.

Additionally, a shaft insertion part 516 into which the hinge shaft of the main lower hinge 54 is inserted may be opened in the lower surface of the decoration 511.

In addition, a door stopper 55 may be further provided on the lower surface of the decoration 511 to prevent the door 212 from opening beyond a set angle. The door stopper 55 may be made of a metal material and may be exposed below the main door 30.

A plurality of holes 552 may be formed in the door stopper 55, and a plurality of second fastening members 57 penetrating the door stopper 55 may pass. For example, the second fastening member 57 may be a screw. The second fastening member 57 may extend to sequentially penetrate the decoration lower surface 511 and the support member 53 and be fastened to the lower surface of the door body 31. Additionally, a shaft insertion hole 551 into which the hinge shaft of the main lower hinge 302 is inserted may be opened in the door stopper 55.

Additionally, an opening prevention device 56 may be mounted on the lower surface of the first part 51 to maintain the door 212 in a closed state.

Meanwhile, the support member 53 is intended to reinforce the strength of the hinge 54 and may be made of a metal material. Therefore, even when the weight of the sub door 40 increases due to the panel 41, the support member 53 can provide a stable support and reinforcement structure for the sub door 40. The support member 53 may be referred to as a reinforcing member or a hinge bracket.

The support member 53 may connect the hinge 54 and the main door 30 on the inside of the lower cap decoration 50. Additionally, the support member 53 may support the hinge 54 from below. Additionally, the support member 53 may be provided inside the lower cap decoration 50 and installed so as not to be exposed to the outside. In addition, the support member 53 may include a first support part 531 fixed to the door body 31 and a second support part 532 supporting the hinge 54. Additionally, the first support part 531 may be located on the first part 51 and the second support part 532 may be located on the second part 52.

In detail, the support member 53 may be formed in a plate shape and may be accommodated inside the support member mounting part 514. The first support part 531 may be located on the body mounting part 322 recessed in the lower surface of the door body 31. In addition, the first support part 531 may be fixed to the door body 31 by the second fastening member 57. A second fastening hole **531*a* into which the second fastening member 57 is fastened may be formed in the first support part 531**.

Additionally, a second support part 532 may be formed at the front end of the first support part 531. The second support part 532 may extend forward and may be formed to be stepped from the first support part 531. At least a portion of the second support part 532 may protrude further than the front surface of the door body 31, that is, the front surface of the main door 30. The second support part 532 may pass through the front end of the body mounting part 322 and protrude forward.

The second support part 532 may be extended to be inserted into the second part 52. The second support part 532 may be located inside the protrusion 525. Additionally, the second support part 532 may extend to the lower surface of the accommodation part 527, and the lower surface of the accommodation part 527 and the upper surface of the second supporting part 532 may overlap each other. Accordingly, the stepped height of the second support part 532 may correspond to the height of the lower surface of the accommodation part 527.

When the first part 51 and the second part 52 are combined and the hinge 54 is mounted, the second support part 532 can support the accommodation part 527 from below. Additionally, the first fastening member 58 fastened through the hinge 54 may pass through the accommodation part 527 and fastened to the second support part 532. A first fastening hole 532*a* into which the first fastening member 58 is fastened may be formed in the second support part 532.

Meanwhile, a front support part 533 may be formed at the front end of the second support part 532. The front support part 533 may be bent downward and may extend to a height corresponding to the lower surface of the first support part 531. Therefore, when the support member 53 is mounted on the lower cap decoration 50, the lower end of the front support part 533 and the lower surface of the first support part 531 may be in contact with the floor of the lower cap decoration 50. Additionally, the front surface of the front support part 533 may be in contact with the inner front surface of the lower cap decoration 50.

At this time, a guide protrusion 517 may be further formed inside the lower cap decoration 50 to guide the mounting position of the support member 53. Additionally, the guide protrusion 517 may be coupled to the guide groove 533*a* formed on the front support part 533. In addition, the guide part 515 for restraining the circumference of the support member 53 may protrude upward from the lower cap decoration 50.

The second part 52 is provided in front of the first part 51, and can be combined with the first part 51 to form a portion of the front and lower surfaces of the lower cap decoration 50. The second part 52 may be formed to have a different texture from the first part 51. As an example, the second part 52 may be formed of a different material from the first part 51. As another example, the second part 52 may be made of a plastic material, and pearl or pigment may be added to make the outer appearance of the upper door 21 more prominent. As another example, when the outer appearances of the front surfaces of the doors 21 and 22 have metal or a metal texture, the second part 52 may be formed to have a corresponding metal color or metal texture.

In other words, the first part 51 is made of a material capable of reinforcing strength, and the second part 52 is made of a high-quality material capable of emphasizing the outer appearance, forming the entire lower cap decoration 50. In addition, the second part 52 can form the outer appearance of the front surface of the lower cap decoration 50 when combined with the first part 51.

Additionally, the second part 52 may be provided with the hinge 54. The hinge 54 may be mounted on the second part 52, and the hinge pin 543 may protrude upward and be axially coupled to the lower surface of the sub door 40.

Hereinafter, the coupling structure of the second part 52 and the hinge 54 of the lower cap decoration 50 will be examined in more detail with reference to the drawings.

Figure 7:
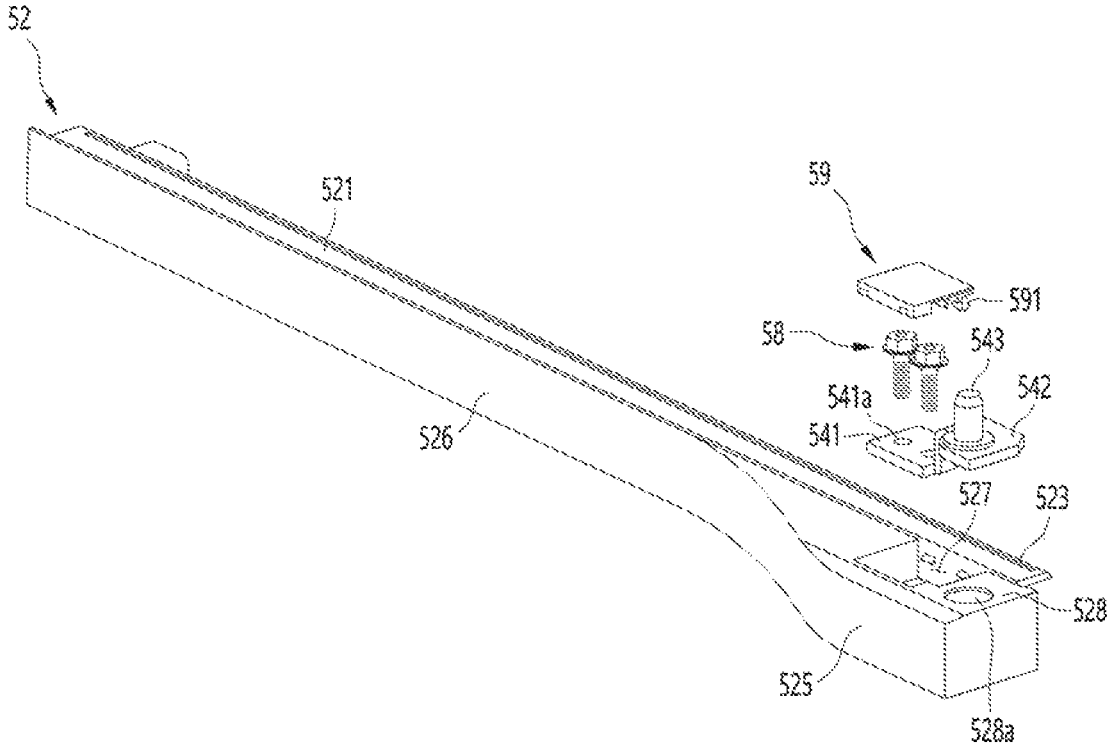
FIG. 7 is an exploded perspective view illustrating the combined structure of the lower cap decoration and the hinge according to an embodiment of the present disclosure.
Figure 8:
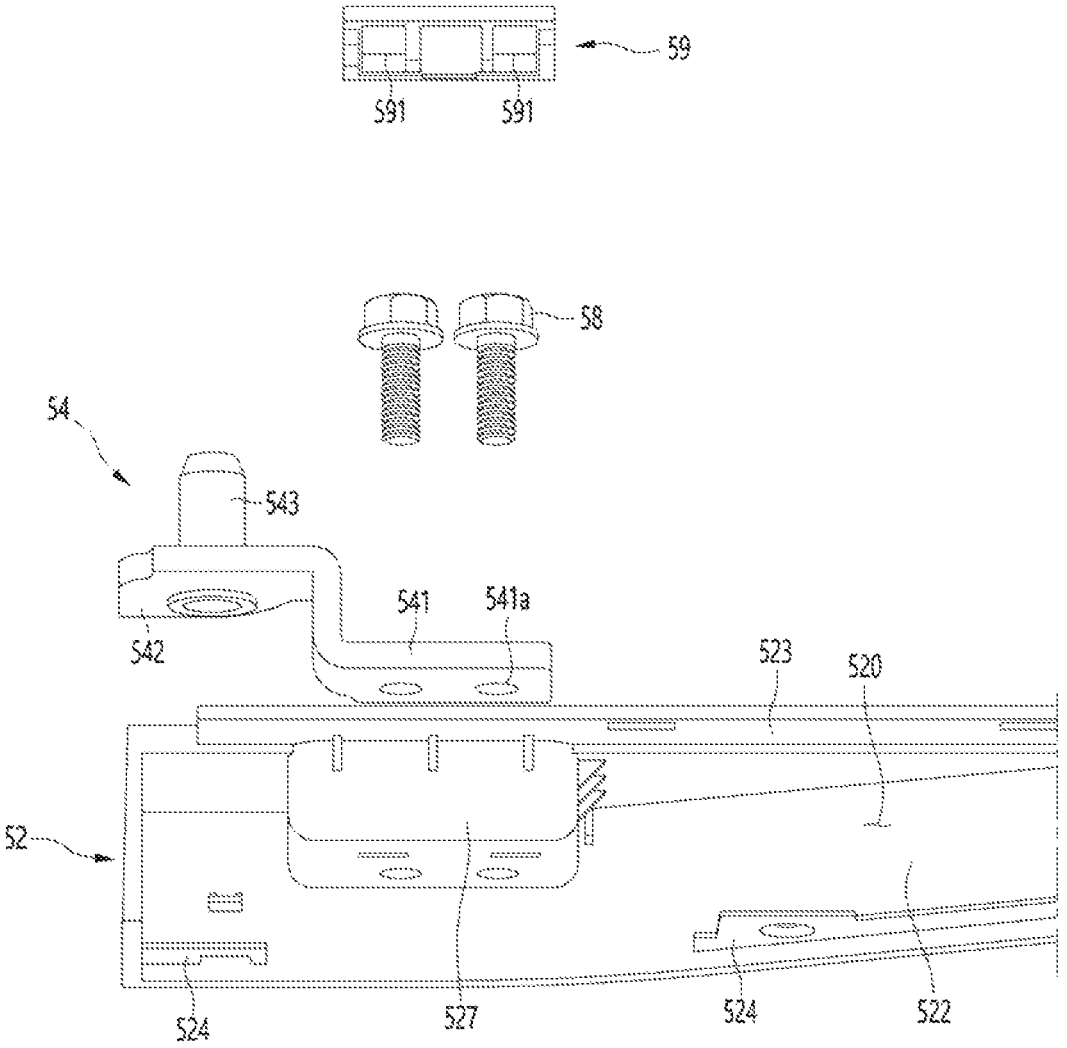
FIG. 8 is an exploded perspective view of the combined structure of the lower cap decoration and the hinge viewed from the rear.

FIG. 7 is an exploded perspective view illustrating the combined structure of the lower cap decoration and the hinge according to an embodiment of the present disclosure, and FIG. 8 is an exploded perspective view of the combined structure of the lower cap decoration and the hinge viewed from the rear.

As illustrated, the second part 52 constituting the lower cap decoration 50 may be molded separately from the first part 51 and may be combined with the first part 51.

The second part 52 may include an upper surface 521 extending long to both left and right ends of the main door 30, and a circumferential surface 522 extending downward from the end portion of the upper surface 521. In addition, the second part 52 may be opened at the rear surface to form an accommodating space 520 therein, and when the first part 51 and the second part 52 are combined, a portion of the first part 51 may be inserted into the inside of the accommodating space 520. Additionally, a portion of the support member 53 may be inserted through the opened rear surface of the second part 52 and positioned inside the second part 52.

A coupling part 523 extending rearward may be formed on the upper surface of the second part 52. The coupling part 523 may be formed along the rear end of the upper surface of the second part 52. Additionally, the coupling part 523 may be formed in a rib-like shape and may be inserted into the coupling groove 323 formed on the front surface of the door body 31. Accordingly, a portion of the second part 52 may be further coupled to the door body 31.

Additionally, a seating rib 524 may be formed along the circumferential portion of the second part 52. The seating rib 524 may be supported at the front end of the first part 51 and may allow the second part 52 and the first part 51 to be coupled to each other. As an example, some of the seating ribs 524 may be formed in a hook shape or may be formed in a lockable structure and may be restrained with the first part 51.

Meanwhile, the protrusion 525 and the recessed part 526 may be formed in the lower cap decoration 50. The protrusion 525 may protrude forward from one end of the second part 52. The protrusion 525 may be formed to protrude further forward than the main door 30. The support member mounting part 514 may be inserted into the inside of the protrusion 525 and may be formed in a shape corresponding to the support member mounting part 514. Additionally, the protrusion 525 may be formed to be the same as the front surface of the sub door 40 or to be located somewhat rearward than the front surface of the sub door 40.

An accommodation part 527 into which the hinge 54 is inserted may be formed on the upper surface of the protrusion 525. The accommodation part 527 may be recessed downward and the upper surface thereof may be open. The hinge 54 may be inserted into the accommodation part 527 from top to bottom, and may be formed in a shape corresponding to the hinge 54 so that the hinge 54 is fixed.

Meanwhile, the accommodation part 527 is recessed downward, and the lower surface of the accommodation part 527 may be positioned higher than the lower surface of the lower cap decoration 50. Also, the fixing part 541 of the hinge 54 can be inserted into the accommodation part 527, and the lower surface of the fixing part 541 can be supported on the bottom of the accommodation part 527. Also, the lower surface of the accommodation part 527 may be in contact with the upper surface of the second support part 532 of the supporting member 53. Accordingly, the fixing part 541 of the hinge 54 may be supported by the accommodation part 527 and the second support part 532.

Additionally, the first fastening member 58 may be fastened to penetrate the fixing part 541, the bottom of the accommodation part 527, and the second support part 532. Accordingly, the hinge 54 may be prevented from rotating inside the accommodation part 527, be stably supported by the bottom of the accommodation part 527, and be reinforced by the support member 53.

Additionally, a hinge seating part 528 may be formed on a side of the accommodation part 527. The hinge seating part 528 may accommodate the bent part 542 of the hinge 54. Additionally, the hinge seating part 528 may be recessed by the thickness of the bent part 542. Additionally, the accommodation part 527 and the hinge seating part 528 may be in contact with each other on the upper surface of the protrusion 525 and may be formed to be stepped from each other.

Therefore, when the hinge 54 is mounted on the lower cap decoration 50, the fixing part 541 is fixed inside the accommodation part 527, and the bent part 542 can be fixed in a seated state at the hinge seating part 528. Additionally, a seating part groove 528*a* in which the lower end of the hinge pin 543 is accommodated may be further formed in the hinge seating part 528.

Additionally, an accommodation part cover 59 may be mounted on the open upper surface of the accommodation part 527. The accommodation part cover 59 may shield the open upper surface of the accommodation part 527. A restraining hook 591 may be formed at the end portion of the accommodation part cover 59, and the restraining hook 591 is locked and restrained on the inner surface of the accommodation part 527 to prevent the accommodation part cover 59 from being separated.

Additionally, the hinge pin 543 of the hinge 54 may extend upward past the accommodation part cover 59 and may be exposed to the outside.

The protrusion 525 may be located further outside (on the right side in the drawing) than the handle 423 formed on the lower surface of the sub door 40. Additionally, the recessed part 526 may be formed from the end portion of the protrusion 525 to the left end of the second part 52. The recessed part 526 may be recessed rearward than the protrusion 525 and may be formed to have a predetermined curvature and roundness. In addition, the recessed part 526 is formed to pass behind the handle 423 and the lower handle 221 to prevent the user's hand from interfering with the handle 423 and the lower handle 221 when operating the handle 423 and the lower handle 221. Additionally, a portion of the front surface of the recessed part 526 may extend in a straight line and may be formed to be located on the same plane as the front surface of the main door 30.

The hinge 54 is used to rotate the sub door 40 and may be made of a metal material. The hinge 54 may include a fixing part 541, a bent part 542, and a hinge pin 543. The fixing part 541 is disposed inside the accommodation part 527 and may be in contact with the floor of the accommodation part 527. Additionally, a fastening hole 541*a* through which the first fastening member 58 passes may be formed in the fixing part 541.

The bent part 542 may be bent upward from one end of the fixing part 541 and then bent laterally again. The bent part 542 may have a stepped shape from the fixing part 541 and may be formed to be seated on the hinge seating part 528. Accordingly, the fixing part 541 is accommodated in the accommodation part 527, and the bent part 542 is disposed in the accommodation part 527 and the hinge seating part 528 and thus the hinge 54 may prevent movement and maintain a stable mounting state.

Additionally, the hinge pin 543 may be provided at the bent part 542. The hinge pin 543 may extend upward and be inserted to pass through the lower surface of the sub door 40. Accordingly, the sub door 40 may be rotated around the hinge pin 543.

Hereinafter, the coupling structure of the support member 53 and the hinge 54 will be examined in more detail with reference to the drawings.

Figure 9:
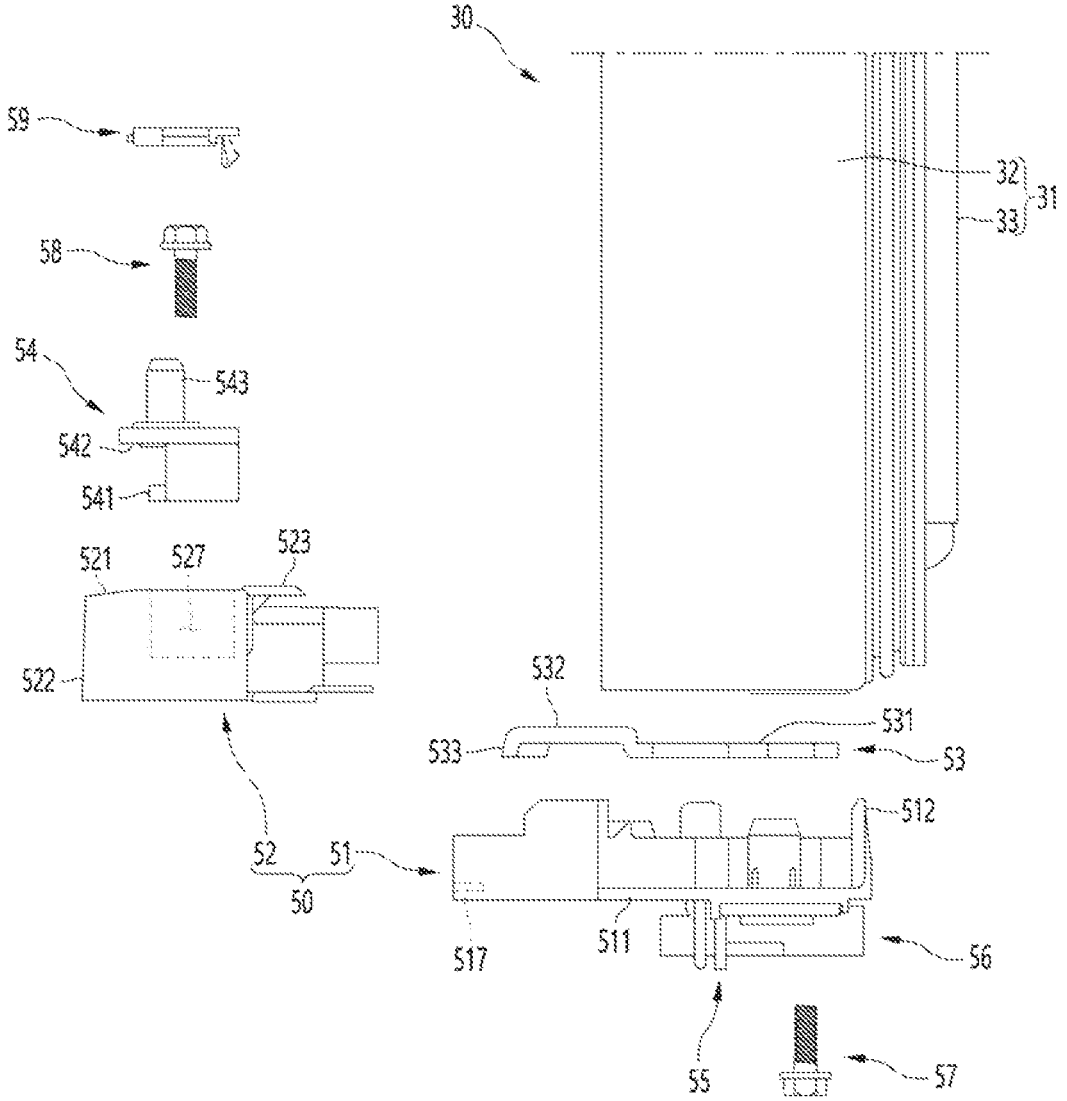
FIG. 9 is an exploded view of the combined structure of the main door and lower cap decoration viewed from the side.

FIG. 9 is an exploded view of the combined structure of the main door and lower cap decoration viewed from the side, and FIG. 10 is a cross-sectional view taken along line 10-10 of FIG. 1.

As illustrated, the lower cap decoration 50 is mounted on the lower surface of the door body 31 for assembly of the main door 30. At this time, the first part 51 is mounted on the lower surface of the door body 31, and the support member 53 may be disposed inside the first part 51.

The first support part 531 is in contact with the lower surface of the door body 31, and a second fastening member 57 penetrating the lower surface of the first part 51 can be fastened to the first support part 531. Additionally, the second fastening member 57 may penetrate the door stopper 55, and the door stopper 55 may also be fixed together.

When the first part 51 is mounted on the door body 31, the second support part 532 may protrude further forward than the front surface of the door body 31. In addition, the second part 52 can be coupled to the first part 51. Additionally, the second part 52 may be further coupled to the front surface of the door body 31. By combining the second part 52, the second support part 532 comes into contact with the lower surface of the accommodation part 527, and supports the hinge 54 from below when the hinge 54 is installed.

The fixing part 541 of the hinge 54 may be inserted into the accommodation part 527, and the bent part 542 may be seated on the hinge seating part 528. In this state, a first fastening member 58 may be fastened to the fixing part 541, and the first fastening member 58 may pass through the bottom of the accommodation part 527 and be fastened to the second support part 532. Accordingly, the hinge 54 may be not only firmly fixed inside the accommodation part 527, but also may be combined with the support member 53 disposed below the accommodation part 527 to further enhance strength thereof.

In addition, the hinge pin 543 provided in the bent part 542 may be inserted through the lower surface of the sub door 40 and is axially coupled to the lower surface of the sub door 40 to rotatably support the sub door.

Therefore, even when the weight of the sub door 40 is heavy, the hinge 54 and the protrusion 525 have a structure reinforced by the support member 53, and the sub door 40 may maintain the installed state thereof without sagging.

Meanwhile, the present disclosure may be possible in various other embodiments in addition to the above-described embodiments. In another embodiment of the present disclosure, the lower cap decoration may be composed of a single structure. In another embodiment of the present disclosure, other configurations except for the lower cap decoration are the same as the above-described embodiment, and the same configurations are indicated using the same reference numerals and detailed descriptions and illustrations thereof may be omitted.

Hereinafter, another embodiment of the present disclosure will be described with reference to the drawings.

Figure 11:
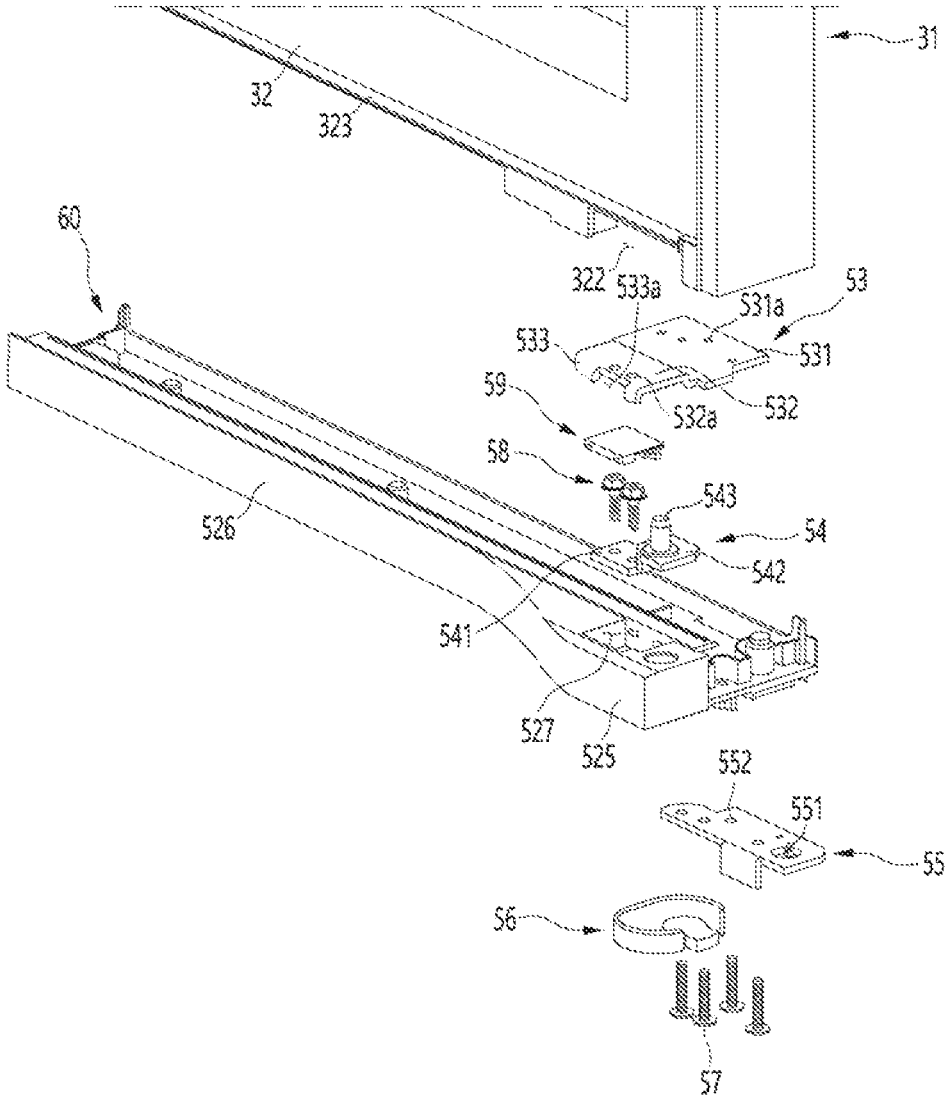
FIG. 11 is an exploded perspective view illustrating the lower structure of the main door according to another embodiment of the present disclosure.

FIG. 11 is an exploded perspective view illustrating the lower structure of the main door according to another embodiment of the present disclosure.

As illustrated, the main door 30 may include a door body 31, a lower cap decoration 60 coupled to the lower surface of the door body 31, and a support member 53 disposed between the door body 31 and lower cap decoration 60.

The lower cap decoration 60 may form a portion of the lower surface and the front surface of the main door 30. The lower cap decoration 60 may be located below the sub door 40 to form the outer appearance of the lower portion of the front surface of the main door 30. At the same time, the lower cap decoration 60 can support the sub door 40 from below and be axially coupled to it.

In detail, the lower cap decoration 60 may include a protrusion 525 that protrudes forward of the door body 31. In addition, the lower cap decoration 60 may further include a recessed part 526 that is recessed rearward from one side of the protrusion 525. Additionally, an accommodation part 527 into which the hinge 54 is inserted may be formed on the protrusion 525.

The hinge 54 may be fixed inside the accommodation part 527. For example, the first fastening member 58 may be fastened to the fixing part 541 of the hinge 54 so that the hinge 54 is fixedly mounted inside the accommodation part 527. Additionally, the bent part 542 of the hinge 54 may be seated on the hinge seating part 528. Additionally, the hinge pin 543 provided on the bent part 542 may be axially coupled to the lower surface of the sub door 40. The open upper surface of the accommodation part 527 may be shielded by the accommodation part cover 59. The first fastening member 58 and the fixing part 541 may be shielded by the accommodation part cover 59.

The support member 53 may be installed inside the lower cap decoration 60. Additionally, the support member 53 may be disposed between the door body 31 and the lower cap decoration 60. The support member 53 may include a first support part 531 coupled to the door body 31 and a second support part 532 extending forward from the first support part 531. The second fastening member 57 fastened below the lower cap decoration 60 may sequentially pass through the lower cap decoration 60 and the first support part 531 and may be fastened to the door body 31. Therefore, the support member 53 may be firmly fixed to the door body 31.

Additionally, the second support part 532 extends further forward than the front surface of the door body 31 and may be configured to support the hinge 54 mounted on the protrusion 525 from below. In addition, the first fastening member 58 penetrating the hinge 54 and the accommodation part 527 is fastened to the second support part 532 to firmly fix the hinge 54.

To this end, the front end of the support member 53, that is, the second support part 532, may be inserted into the protrusion 525. The second support part 532 is inserted from the rear of the accommodation part 527, and the upper surface of the second supporting part 532 may be in contact with the bottom surface of the accommodation part 527. Accordingly, the support member 53 may support the hinge 54 from below.

Therefore, even if the heavy sub door 40 is mounted, the hinge 54, which has a structure reinforced by the support member 53, can stably support the sub door 40. Additionally, the hinge 54 is mounted within the accommodation part 527 of the lower cap decoration 60 to minimize external exposure.

Meanwhile, the present disclosure may be possible in various other embodiments in addition to the above-described embodiments. Another embodiment of the present disclosure is characterized in that the lower cap decoration is further provided with a lower support member for further supporting the hinge to reinforce the support structure of the sub door. In addition, another embodiment of the present disclosure has the same configuration as the above-described embodiment except for the lower support member and some configurations that have the same coupling relationship with the lower support member, and the same configuration is indicated using the same reference numeral, and detailed descriptions and illustrations thereof may be omitted.

Hereinafter, another embodiment of the present disclosure will be described with reference to the drawings.

Figure 12:
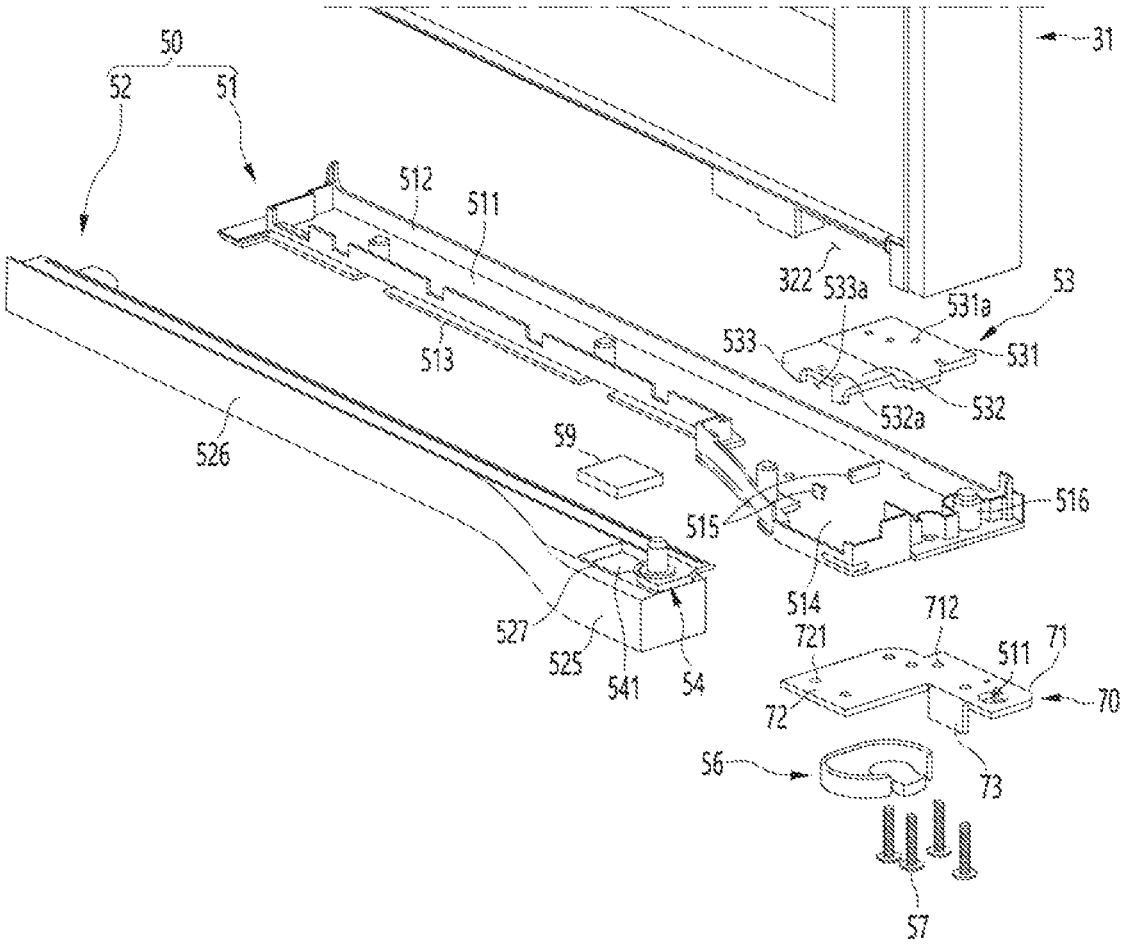
FIG. 12 is an exploded perspective view illustrating the lower structure of the main door according to another embodiment of the present disclosure.
Figure 13:
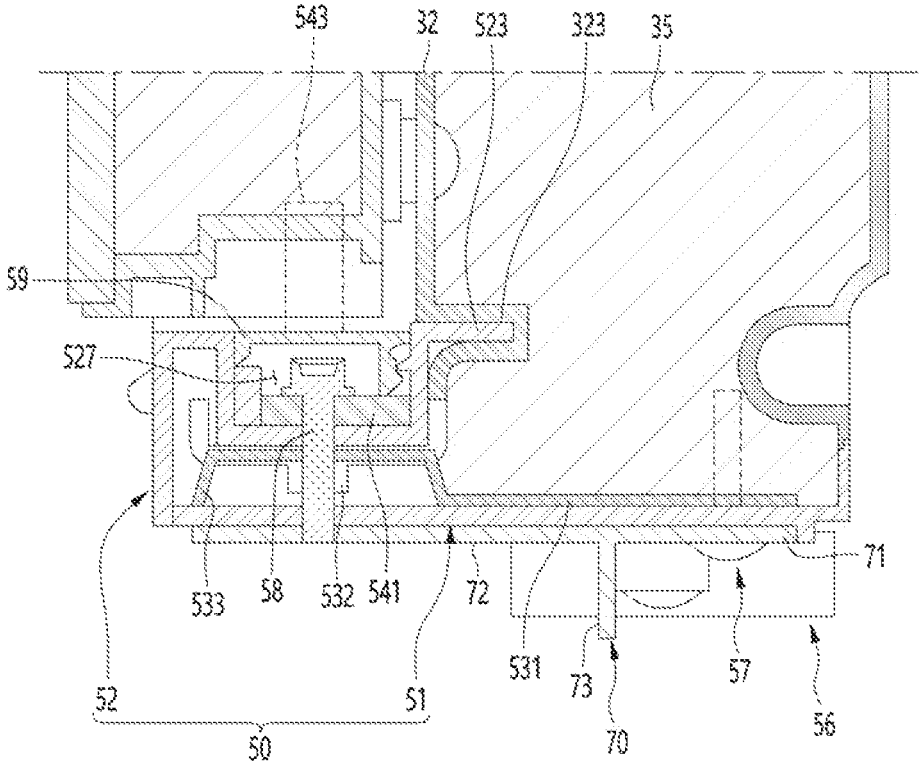
FIG. 13 is a cross-sectional view of a state where a sub door is mounted on the main door.

FIG. 12 is an exploded perspective view illustrating the lower structure of the main door according to another embodiment of the present disclosure, and FIG. 13 is a cross-sectional view of a state where a sub door is mounted on the main door.

As illustrated, in the refrigerator 1 according to another embodiment of the present disclosure, the door 212 may include a main door 30 and a sub door 40.

A lower cap decoration 50 may be provided on the lower surface of the door body 31 constituting the main door 30. The lower cap decoration 50 may be mounted on the lower surface of the door body 31 to form the lower surface of the main door 30.

A protrusion 525 may be formed on one end of the lower cap decoration 50. The protrusion 525 protrudes further forward than the door body 31 and can rotatably support the sub door 40 from below. In addition, on the front surface of the lower cap decoration 50, a recessed part 526 may be formed on the front surface of lower cap decoration 50, which is recessed further rearward than the front surface of the sub door 40.

The lower cap decoration 50 may be equipped with a support member 53, a lower support member 70, an opening prevention device 56, and a hinge 54.

The lower cap decoration 50 may include a first part 51 coupled to the lower surface of the door body 31, and a second part 52 coupled to the first part 51 and the door body 31. The first part 51 may form a lower surface of the main door 30, and the second part 52 may form a portion of the front surface of the main door 30.

The first part 51 may include a decoration lower surface 511 and a decoration circumferential surface 512. Additionally, a coupling part 513 coupled to the second part 52 may protrude from the lower surface of the decoration 511. The decoration lower surface 511 may be formed with a support member mounting part 514 into which the support member 53 is mounted and a shaft insertion part 516 in which the guide part 515 is formed and into which the hinge shaft of the lower main hinge 302 is inserted.

Additionally, the protrusion 525 may be formed on one end of the second part 52. Additionally, the recessed part 526 may be formed on a side of the protrusion 525. The recessed part 526 may extend from the protrusion 525 to the other end of the second part 52.

A hinge 54, which becomes the rotation shaft of the sub door 40, may be mounted on the upper surface of the second part 52, that is, the upper surface of the protrusion 525. In detail, the accommodation part 527 into which the hinge 54 is inserted may be recessed on the upper surface of the protrusion 525.

With the hinge 54 disposed inside the accommodation part 527, the first fastening member 58 may be fastened so that the hinge 54 is fixed to the second part 52. Additionally, the accommodation part 527 is shielded by the accommodation part cover 59, and the hinge pin 543 of the hinge 54 may protrude through the accommodation part cover 59.

Meanwhile, the hinge 54 may be formed of a metal material and may include a fixing part 541 and a hinge pin 543. The fixing part 541 may be seated on the stepped inner side of the accommodation part 527. Additionally, a fastening hole 541*a* through which the first fastening member 58 passes may be formed in the fixing part 541. The first fastening member 58 may be fastened above the fixing part 541 to penetrate the hinge 54, the lower cap decoration 50, and the lower support member 70.

A support member 53 may be provided between the first part 51 and the second part 52. The support member 53 is mounted on the support member mounting part 514 formed on the first part 51, and the accurate mounting position may be maintained by the guide part 515. In addition, the support member 53 may be inserted into the body mounting part 322 when the lower cap decoration 50 is coupled. Accordingly, the support member 53 may maintain a sturdy mounting structure and mounting state.

The support member 53 is formed in the shape of a metal plate and may include a first support part 531 and a second support part 532.

The first support part 531 forms the latter half of the support member 53 and may be coupled to the door body 31. In addition, the first support part 531 may be fixed in contact with the lower surface of the door body 31 and the upper surface of the first part 51. In addition, a first fastening hole 531*a* into which the second fastening member 57 is fastened may be formed in the first support part 531. The second fastening member 57 is fastened below the first part 51 and penetrates the lower support member 70, the first part 51, and the support member 53 to connect the door body 31. Accordingly, the support member 53 and the lower support member 70 may be more firmly fixed to the door body 31.

The second support part 532 may protrude from the front end of the first support part 531 and be bent from the first support part 531. The strength of the support member 53 can be strengthened due to the stepped shape of the first support part 531 and the second support part 532. The second support part 532 may protrude upward from the first support part 531. The second support part 532 protrudes further than the front surface of the door body 31 and may extend to support the lower surface of the accommodation part 527. Accordingly, the second support part 532 can indirectly support the hinge 54 from below. The second support part 532 may directly support the hinge 54 from below, if necessary.

A second fastening hole 532*a* may be formed in the second support part 532 to which the first fastening member 58 penetrating the hinge 54 is fastened. Additionally, a front support part 533 and a guide groove 533*a* may be formed at the front end of the second support part 532.

The lower support member 70 may be provided on the lower surface of the lower cap decoration 50. The lower support member 70 may be formed in a plate shape made of metal, be coupled to the hinge 54 by the first fastening member 58, and be coupled to the support member 53 by the second fastening member 57. Therefore, the lower support member 70 may increase the strength of the support member 53 and heavy sub door 40 may be supported more stably.

In detail, the lower support member 70 is provided on the first part 51 and below the support member 53. The upper support member 53 may be provided on the upper surface with respect to the first part 51, and the lower support member 70 may be provided on the lower surface.

The lower support member 70 may include a rear part 71 and a front part 72. The rear part 71 may be located at a position corresponding to the support member 53. Additionally, the rear part 71 may be disposed so that at least a portion of the rear part 71 overlaps the support member 53 vertically.

A rear fastening hole 712 through which the second fastening member 57 passes may be formed in the rear part 71. Accordingly, the support member 53 can be more firmly fixed and reinforced by the rear part 71. Additionally, a shaft insertion hole 711 into which the hinge shaft of the lower main hinge 302 is inserted may be formed in the rear part 71.

The front part 72 may protrude forward from the rear part 71. Additionally, the front part 72 may extend to a position corresponding to the hinge 54. The front part 72 may be disposed so that at least a portion of the front part 72 overlaps the fixing part 541 of the hinge 54 vertically.

A front fastening hole 721 through which the first fastening member 58 passes may be formed in the front part 72. Accordingly, the hinge 54 may be more firmly fixed by the front part 72 and the sub door 40 may be reinforced to prevent it from sagging.

Meanwhile, a stopper part 73 protruding downward may be further formed on the lower support member 70. The stopper part 73 may be configured to prevent the door 212 from opening beyond a set angle by interfering with the lower main hinge 302 when the door 212 is opened. Therefore, the lower support member 70 may also be referred to as a stopper.

Of course, the stopper part 73 may be omitted, or may be provided as a separate component and mounted on the lower surface of the lower cap decoration 50.

Meanwhile, the present disclosure may have a structure in which the support member 53 is omitted inside the lower cap decoration 50 and the lower support member 70 is coupled to the lower surface of the door body 31, and which supports the hinge 54 from below.

What is claimed is:

1. A refrigerator comprising:

a cabinet having a storage space;

a main door rotatably mounted to the cabinet, the main door being configured to open and close the storage space, the main door having:

a door body defining a circumference of an opening of the main door, the door body being filled with an insulating material; and a lower cap decoration coupled to the door body to define a portion of a lower surface of the main door and a portion of a front surface of the main door;

a sub door located in front of the main door, the sub door being configured to open and close the opening of the main door;

a hinge rotatably coupled to the sub door; and a support member provided between a lower surface of the door body and the lower cap decoration and covered by the lower cap decoration, the support member being formed of a metal material, the support member including:

a first support part coupled such that an upper surface thereof contacts with a lower surface of the door body and a lower surface of the first support part contacts the lower cap decoration; and a second support part extending from a front end of the first support part and protruding further forward than a front surface of the door body, wherein the hinge is mounted on the lower cap decoration so as to be coupled to the second support part disposed below the hinge.

2. The refrigerator of claim 1, wherein the lower cap decoration includes a protrusion that protrudes further forward than the front surface of the door body, and wherein the hinge is mounted on the protrusion.

3. The refrigerator of claim 2, wherein the protrusion includes an accommodation part recessed from an upper surface of the protrusion, and wherein the hinge is inserted in the accommodation part.

4. The refrigerator of claim 2, wherein the protrusion protrudes forward from below the sub door, and wherein the lower cap decoration is exposed below the sub door.

5. The refrigerator of claim 2, wherein a lower surface of the sub door includes a recessed handle spaced opposite the hinge in a left-right direction of the sub door, and wherein a front surface of the lower cap decoration includes a recessed part which extends further rearward than the handle opposite the protrusion in the left-right direction.

6. The refrigerator of claim 5, wherein the storage space includes an upper storage space and a lower storage space, wherein the refrigerator further includes a lower door to open and close the lower storage space, the lower door having a lower handle recessed in an upper surface of the lower door, wherein the main door is provided as a pair of main doors, the pair of main doors being configured to open and close the upper storage space, wherein the recessed parts of the lower cap decorations of the pair of main doors are located behind the lower handle, and wherein the protrusions of the lower cap decorations of the pair of main doors are located at opposite ends of the lower handle.

7. The refrigerator of claim 1, wherein a step is provided between the first support part and the second support part such that the second support part is higher than the first support part.

8. The refrigerator of claim 1, wherein the lower cap decoration includes a recessed accommodation part to accommodate the hinge, and wherein the second support part supports a lower surface of the accommodation part.

9. The refrigerator of claim 8, further comprising a fastening member extending through the hinge and the accommodation part, the fastening member being fastened to the second support part.

10. The refrigerator of claim 1, further comprising a fastening member extending through the lower cap decoration and the first support part, the fastening member being fastened to the door body.

11. The refrigerator of claim 7, wherein a front end of the second support part includes a downwardly bent front support part, the downwardly bent front support part including a lower end contacting a lower surface of the lower cap decoration.

12. The refrigerator of claim 1, wherein the lower cap decoration includes:

a first part coupled to the lower surface of the door body to define the lower surface of the main door; and a second part coupled to the first part, the second part protruding forward from a lower end of the front surface of the main door, and wherein the hinge is mounted on the second part.

13. The refrigerator of claim 12, wherein the first part has a different texture than the second part.

14. The refrigerator of claim 12, wherein the second part includes:

an upper surface protruding further forward than the front surface of the main door; and a circumferential surface extending downward along a front end of the upper surface, the circumferential surface being exposed below the sub door, wherein at least a portion of a rear surface of the second part is open, wherein the hinge is inserted into the upper surface, and wherein the support member is inserted in the portion of the rear surface.

15. The refrigerator of claim 1, wherein the lower cap decoration includes a recessed accommodation part to accommodate the hinge, and wherein the hinge includes:

a fixing part inserted into the recessed accommodation part of the lower cap decoration;

a bent part extending stepwise from one end of the fixing part, the bent part being seated on an upper surface of the recessed accommodation part; and a hinge pin protruding upward from the bent part, the hinge pin being coupled to a lower surface of the sub door.

16. The refrigerator of claim 1, further comprising a lower support member located on an outer surface of the lower cap decoration to reinforce the support member.

17. The refrigerator of claim 16, further comprising:

a first fastening member configured to sequentially penetrate the hinge, the support member, and the lower cap decoration, the first fastening member being fastened to the lower support member; and a second fastening member configured to sequentially penetrate the lower support member, the lower cap decoration, and the support member, the second fastening member being fastened to the door body.

18. The refrigerator of claim 16, further comprising a stopper protruding downward from the lower support member, the stopper being configured to restrict a rotation angle of the main door.

* * * * *